United States Patent [19]

Galluppi

[11] 4,239,960

[45] Dec. 16, 1980

[54] RECIRCULATING LIGHT AMPLIFIER WITH OPTICAL FEEDBACK

[75] Inventor: Filippo B. Galluppi, North Hills, N.Y.

[73] Assignee: Venus Scientific Inc., Farmingdale, N.Y.

[21] Appl. No.: 61,845

[22] Filed: Jul. 30, 1979

[51] Int. Cl.[3] ..... H01J 31/50

[52] U.S. Cl. ..... 250/213 VT; 250/213 R

[58] Field of Search ..... 250/213 VT, 213 R, 207

[56] References Cited

U.S. PATENT DOCUMENTS 3,154,687 10/1964 Perl et al. ..... 250/213 VT

*Primary Examiner*—David C. Nelms

*Assistant Examiner*—Darwin R. Hostetter

*Attorney, Agent, or Firm*—Ostrolenk, Faber, Gerb & Soffen

[57] ABSTRACT

A light amplification device utilizes a light intensification tube and optical feedback means for feeding back to the intensification tube for further intensification an image already intensified thereby. The feedback means is connected in such a manner that the fed-back image and the image being intensified for the first time are fed into separate, non-overlapping portions of the input surface of the light intensification tube.

12 Claims, 4 Drawing Figures

RECIRCULATING LIGHT AMPLIFIER WITH OPTICAL FEEDBACK

BACKGROUND OF THE INVENTION

This invention pertains to light amplification systems, particularly to those utilizing light intensifier tubes.

Light intensifier tubes of a great variety of designs have long been known and used in various military and civil applications requiring the viewing or photographing of a scene that is illuminated inadequately for viewing with the naked eye or with ordinary optical systems. The typical light intensifier tube, however, cannot amplify light as much as many purposes require. The conventional solution of this problem is to cascade several intensifier tubes to obtain the necessary gain, which may be as large as 100,000 to 1. A cascade of light intensifier tubes, however, has the drawback of being very expensive.

If the light intensifier tubes used employ electrostatic lens focusing, a cascade has a further disadvantage. The phosphor screen (output) of each tube must be held at a fixed electrical potential (e.g. 15 kV) above the photocathode (input) of the tube; furthermore, the phosphor screen of each tube must be at the same potential as the photocathode of the next tube of the cascade, with which it is in physical contact. Thus, the phosphor screen of the third tube in a cascade must be at a very high voltage, e.g. 45 kV, above the photocathode of the first tube in the cascade. This, obviously, requires a relatively large and expensive power supply.

The present inventions use an optical feedback system to reduce the number of cascaded light intensifier tubes required. Feedback systems to be used in conjunction with light amplification systems are known, e.g. U.S. Pat. No. 3,154,687, issued to Perl et al. One problem encountered in the design of an optical feedback system is the very serious one of registering the fedback image with the original input more-or-less perfectly. If this problem is neither solved nor avoided, the resultant output image will be blurred.

It is the primary purpose of the present invention to overcome these disadvantages of light amplification systems involving a cascade of light intensifier tubes and the problems associated with conventional optical feedback systems.

SUMMARY OF THE INVENTION

In one embodiment, the present invention comprises simply a light intensifier tube and an optical system connected to the tube in such a manner that an image to be amplified is put through the tube a sufficient number of times to attain the desired intensity. Before it is introduced into the tube the first time, the image is reduced in size so that it occupies substantially less than 1/n of the total area of the photocathode of the tube, where n is the number of times the image is to be passed through the tube. The image that has been intensified by one passage through the tube is returned by the feedback system to the photocathode, where it is input a second time into a different portion of the photocathode from where it was input initially. Each time the image is fed back, it is fed to a new section of the photocathode that does not overlap any of the other portions into which the image is input. In this way, the problem of aligning each fed-back image perfectly with the original image, noted above, is avoided altogether.

It should be noted that since each image is normally circular, the above design does not employ the entire area of the phosphor screen or of the photocathode. It is therefore possible to employ an intensifier tube that has minor defects on its phosphor screen or photocathode surface or both. Such tubes cannot be used for many other purposes so that it is possible to acquire, relatively inexpensively, slightly defective tubes satisfactory for use in the device of the present invention.

It should also be noted that electrostatic light intensifier tubes tend to magnify the image by an amount that varies as the distance from the center of the phosphor screen increases. Since each image is relatively small in the device of the present invention, it is subject to relatively little distortion compared to the layer image of conventional light amplification systems that employ electrostatic light intensifier tubes.

In other embodiments, the apparatus described above is associated with additional optical systems to form devices with which television or other cameras can be used in illumination that would otherwise be inadequate. Again, two sets of the apparatus described above could be coupled together to provide an intensified binocular image.

It is the primary object of the present invention to provide compact and economical means with which the human eye can, without other aid, see clearly in poor light, and even at night.

It is a further object to provide such means that can utilize light intensifier tubes of a quality that could otherwise not be used, thus lowering the cost of the device of the invention further and lowering the average cost for intensifier tubes themselves.

It is another object to provide such means having less distortion than conventional light amplification systems that employ electrostatic intensification tubes.

These and other objects and advantages of the present invention will become clearer from the following detailed description taken in conjunction with the accompanying figures.

DETAILED DESCRIPTION OF THE INVENTION

Figure 1:
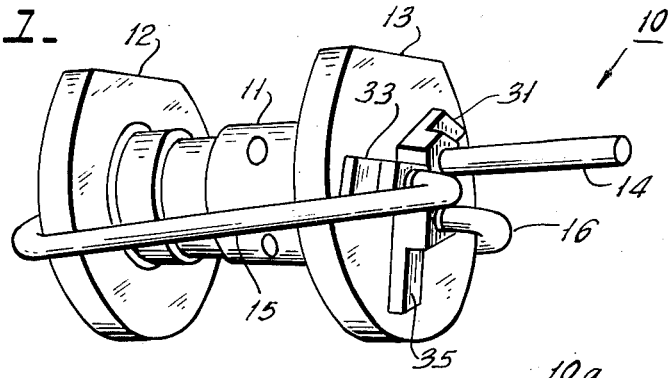
FIG. 1 shows one embodiment in perspective.
Figure 3:
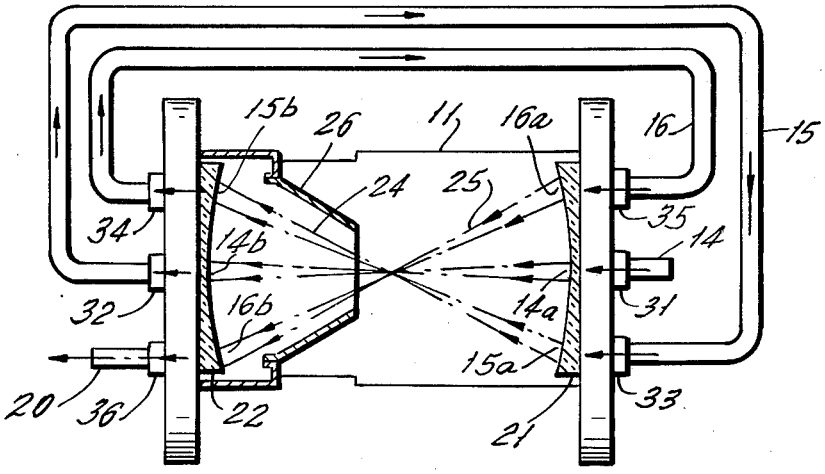
FIG. 3 shows a view similar to that of FIG. 2, of the embodiment of FIG. 1.

One embodiment, shown in FIGS. 1 and 3, comprises, in essence, merely a conventional light intensifier tube 11 and feedback means 15, 16 and 31–36. The electrostatically focused tube 11, shown schematically in section in FIG. 3, has a conical anode 26, having a hole at its aperture through which the electron beams will pass, and mounted in the housing of the tube 11. At the same end of the tube 11 as the anode 26 is mounted a phosphor screen 22, on the exterior surface 22*a* of which the output intensified image appears. At the opposite end is mounted the photocathode 21. As is well known, an image to be intensified is projected on, or otherwise led to, the exterior surface 21*a* of the photocathode 21, which emits electrons in response to the input image. (In FIG. 3, three beams 23, 24 and 25 of electrons are shown, corresponding to images input in portions 14*a*, 15*a* and 16*a* of the photocathode 21, respectively.) The beam 23, 24 or 25 of electrons is focused and inverted by the anode 26 and strikes the phosphor screen 22, which displays a greatly intensified image at point 14*b*, 15*b* or 16*b*, respectively. Intensifier tubes of this type can be obtained from various manufacturers, e.g., Varo Electron Devices, Inc. Other types of light intensifier tubes, of course, could be utilized instead.

The tube 11 is held between and secured to clamps 12 and 13. The ends of feedback path 15, preferably composed of a bundle of coherent optical fibers, are connected to the respective end faces of the tube 11, as are the ends of a second feedback path 16. An input path 14, also preferably composed of a bundle of optical fibers, is attached to the exterior surface 21*a* of the photocathode 21, and an output path 20 is connected to the phosphor screen 22. In this embodiment, the connections between the optical fiber bundles and the end faces of the tube 11 are made by means of clamps 31, 33 and 35 that secure the end of each fiber optic bundle to the face of the photocathode 21 flushly, and clamps 32, 34 and 36 that serve a similar function at the phosphor screen end of the intensifier tube 10.

The image to be intensified is initially input through input path 14 onto photocathode 21. It is transmitted to phosphor screen 22 as electron beam 23, which is amplified by the high potential (e.g. 15 kV) applied across the anode and cathode of the intensifier tube 11. The electron beam 23 produces an image at point 14*b* on the phosphor screen 22, which is received by feedback path 15. The feedback fiber bundle 15 conveys the image to point 15*a* on the photocathode 21. This image is further intensified by the voltage across the anode and cathode of tube 11 and is transmitted as electron beam 24 to the phosphor screen 22 where it is reproduced at point 15*b*. This image is again fed back and further intensified, and finally output via output fiber bundle 20.

As shown in FIG. 3, the fiber optic bundles 14, 15 and 16 input the optical images onto a relatively small portion of the surface of the photocathode 21. In the preferred embodiment, less than 50%, and as little as 10%, of the face photocathode 21 is used. This is desirable because it permits the use of phototubes having a fairly high number of defects in the photocathode surface. As a result, less costly photocathodes may be utilized. This is a highly desirable result for non-military applications wherein the resolution of the intensifier need not be so high but where cost is a primary factor.

The device of this embodiment may be housed in a casing of some convenient design with a suitable power supply. Two devices of this type may be combined to provide binocular night vision. The device of this embodiment can be used with the human eye for direct viewing, or in conjunction with or as part of a camera or videotape machine.

In another embodiment, a lens system could be interposed between each end of each fiber optic bundle and the adjacent face of the photocathode 21 or of the phosphor screen 22. In any embodiment, direct contact between the optical fiber ends and whatever component, lens or tube they are optically adjacent to is necessary, since otherwise considerable intensity would be lost.

Figure 2:
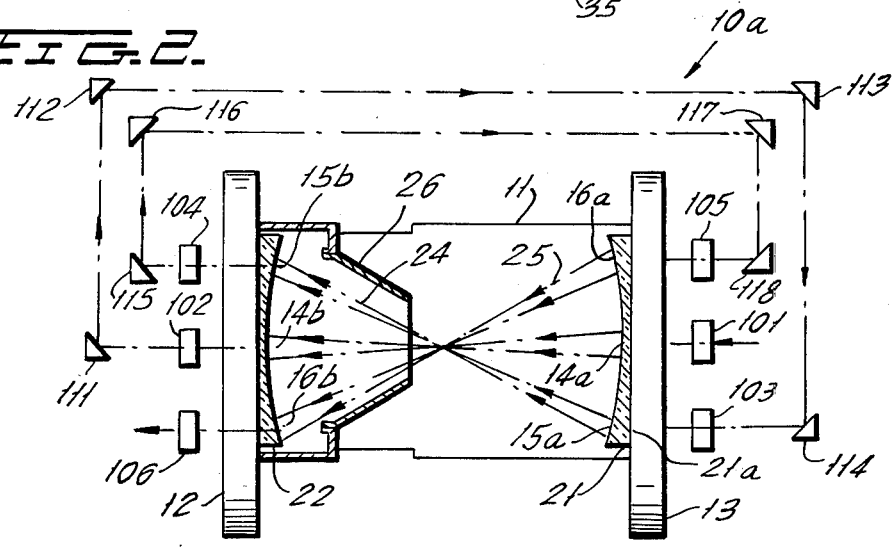
FIG. 2 shows a schematic view, in cross-section, of another embodiment.

In the embodiment of FIG. 2, the fiber optic bundles shown in FIG. 1 have been replaced by a system of lenses 101–106 and prism mirrors 111–118. The image to be intensified is input to the photocathode 21 via lens 101. The once-intensified image is passed through a focusing lens system 102 and is returned by means of prismatic mirrors 111–114 and lens system 103 to the photocathode 21. Similarly, lens systems 104 and 105 and mirrors 115–118 return the twice-intensified image to the photocathode 21, and lens system 106 focuses the final image.

Figure 4:
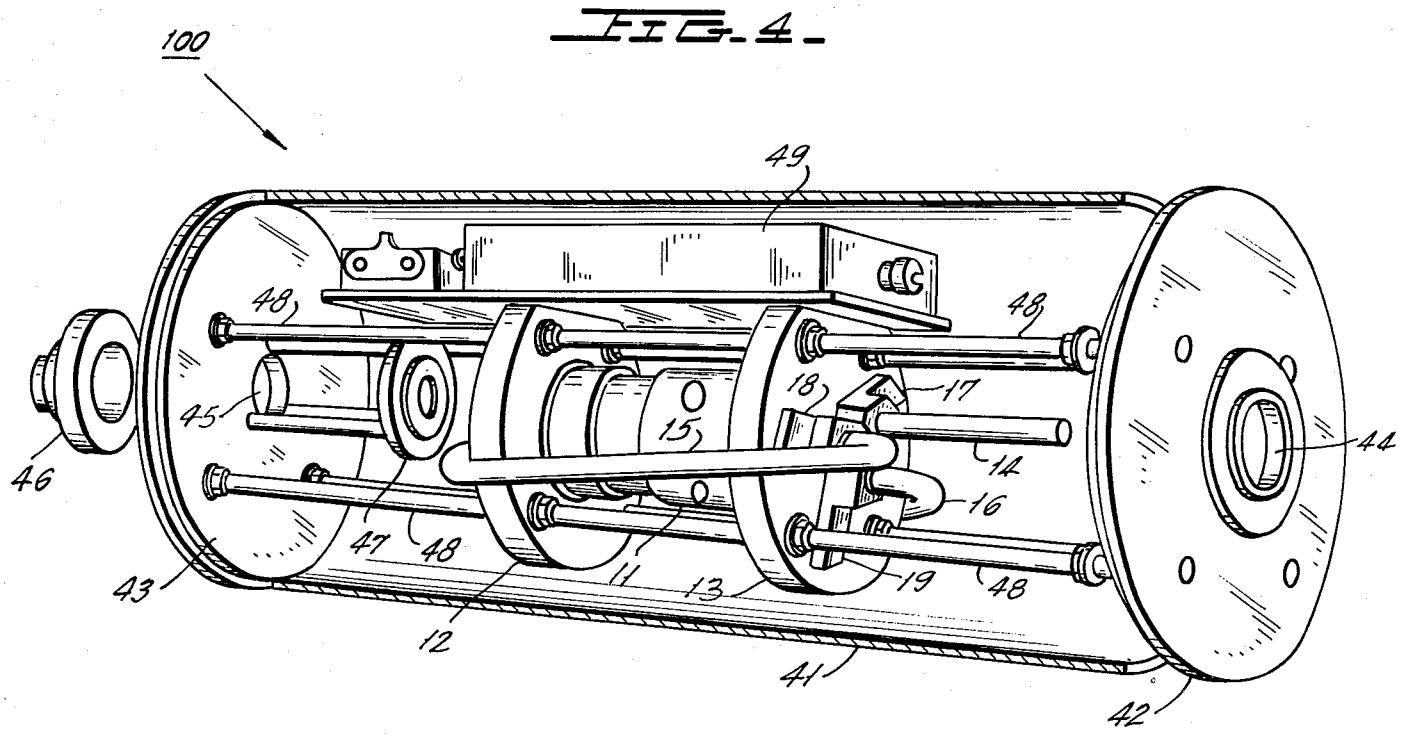
FIG. 4 shows a further embodiment of the invention.

FIG. 4 shows another embodiment of the present invention, for use in a television camera system. The device of the embodiment of FIGS. 1 and 3 is mounted by eight parallel rods 48 between the end plates 42, 43 of a cylindrical housing. Each end plate 42, 43 is provided with a central aperture 44, 45 for input and output, respectively. An exterior objective lens mount 46 is secured to the center of rear end plate 43 (illustrated in an exploded view), and a lens 47 is mounted between the output 20 (see FIG. 3) of the tube 11 and the aperture 45 of the rear end plate 43. The power supply 49 is mounted within the cylindrical housing, adjacent the tube clamps 12, 13. The image of the object is focused by a lens in the aperture 44 in the front end plate 42 onto the end of input path 14. It is then intensified as described above, and the intensified image is focused by lens 47 and by a lens mount 46, and can then be videotaped or broadcast.

Although the present invention has been described in connection with several preferred embodiments, many modifications and variations thereof will now be apparent to one skilled in the art. As such, the scope of the present invention should be defined not by the details of the embodiments described above, but only by the terms of the appended claims.

What is claimed is:

1. A light amplification device, comprising:

a light intensifier tube including an input end face and an output end face, said light intensifier tube intensifying an image input onto said input end face and reproducing said image in intensified form on said output end face;

means for inputting an image to be intensified onto a first portion of said input end face whereby an intensified image is reproduced on a first portion of said output end face; and optical feedback means for feeding back said intensified image reproduced on said output end face and for inputting said intensified image onto a second portion of said input end face which does not overlap said first portion of said input end face whereby a reintensified image is reproduced on a second portion of said output end face.

2. The device of claim 1, wherein said input end face is a photocathode and wherein said first and second portions of said input end face cumulatively define no more than 50% of the active surface of said photocathode.

3. The device of claim 1, wherein said optical feedback means comprises a bundle of optical fibers.

4. The device of claim 3, wherein said bundle is connected directly to each of said end faces of said light intensifier tube.

5. The device of claim 3, wherein said light intensifier tube employs electrostatic focusing.

6. The device of claim 1, wherein said image inputting means includes a first lens means for focusing an image to be intensified onto said input end face of said light intensifier tube.

7. The device of claim 6, further comprising second lens means for focusing an output image which has been intensified by said light amplification device.

8. The device of claim 1, wherein said input end face is a photocathode and said first and second portions of said input end face cumulatively define a total of no more than 15% of the active surface of said photocathode.

9. The device of claim 1, further including second optical feedback means for feeding back said reintensified image reproduced on said output end face and for inputting said reintensified image onto a third portion of said input end face that does not overlap said first or second portions of said input end face, whereby a further intensified image is reproduced on a third portion of said output end face.

10. The device of claim 9, wherein said input end face is a photocathode and wherein said first, second and third portions of said input end face cumulatively define no more than 50% of the active surface of said photocathode.

11. The device of claim 10, wherein said input end face is a photocathode and wherein said first, second and third portions of said input end face cumulatively define no more than 20% of the active surface of said photocathode.

12. A binocular light amplification device, comprising:

a first light amplification tube, including a first input end face and a first output end face, and intensifying a first image input onto said first input end face and reproducing said first image in intensified form on said first output end face;

first means for inputting a first image to be intensified onto a first portion of said first input end face, whereby a first intensified image is reproduced on a first portion of said first output end face;

first optical feedback means for feeding back said first intensified image reproduced on said first output end face and for inputting said first intensified image onto a second portion of said first input end face that does not overlap said first portion of said first input end face, whereby a first reintensified image is reproduced on a second portion of said first output end face;

a second amplification tube, including a second input end face and a second output end face, and intensifying a second image input onto said second input end face and reproducing said second image in intensified form on said second output end face;

second means for inputting a second image to be intensified onto a first portion of said second input end face, whereby a second intensified image is reproduced on a first portion of said second output end face;

second optical feedback means for feeding back said second intensified image reproduced on said second output end face and for inputting said second intensified image onto a second portion of said second input end face that does not overlap said first portion of said second input end face, whereby a second reintensified image is reproduced on a second portion of said second output end face; and means for coupling said first light intensifier tube, first input means and first optical feedback means with said second light intensifier tube, second input means and second optical feedback means so that said first and second reintensified images together constitute an intensified binocular image of the same subject matter.

* * * * *